US006866309B1

(12) United States Patent
Marks

(10) Patent No.: US 6,866,309 B1
(45) Date of Patent: Mar. 15, 2005

(54) SECURITY BOLT LATCH APPARATUS AND METHOD

(76) Inventor: Chester J. Marks, 700 W. Alexander, Lafayette, LA (US) 70501

( * ) Notice: Subject to any disclaimer, the term of this patent is extended or adjusted under 35 U.S.C. 154(b) by 4 days.

(21) Appl. No.: 10/402,219

(22) Filed: Mar. 27, 2003

(51) Int. Cl.[7] ..... E05C 5/02

(52) U.S. Cl. ..... 292/57; 292/DIG. 53; 292/262

(58) Field of Search ..... 292/57, 58, 262, 292/265, 266, 271, DIG. 53

(56) References Cited

U.S. PATENT DOCUMENTS

| | | | | | |
|---|---|---|---|---|---|
| 635,432 | A | | 10/1899 | Doyle | |
| 646,810 | A | | 4/1900 | Doyle | |
| 1,388,712 | A | | 8/1921 | Hoffman | |
| 1,394,278 | A | | 10/1921 | Cirac | |
| 1,799,265 | A | * | 4/1931 | Unkelbach et al. | 292/272 |
| 2,116,001 | A | | 5/1938 | Schlage | |
| 2,581,629 | A | * | 1/1952 | Calderwood | 292/262 |
| 3,797,868 | A | * | 3/1974 | Carey | 292/57 |
| 4,524,590 | A | * | 6/1985 | Budish | 70/129 |
| 4,655,487 | A | * | 4/1987 | Korn et al. | 292/57 |
| 4,758,032 | A | * | 7/1988 | Tindall | 292/265 |
| 5,007,669 | A | | 4/1991 | Pomerleau | |
| 5,531,490 | A | | 7/1996 | Parker | |
| 5,613,718 | A | | 3/1997 | Lin | |
| 5,899,509 | A | | 5/1999 | Ferguson et al. | |
| 6,003,908 | A | * | 12/1999 | King | 292/61 |

* cited by examiner

*Primary Examiner*—Gary Estremsky
(74) *Attorney, Agent, or Firm*—Robert N. Montgomery

(57) ABSTRACT

A deadbolt latch body externally mounted to an interior door encasement by an unconventional method. The latch assembly, including a slotted receiver member fastened to a hinged door adjacent the latch, includes a crank-shaped shot bolt carried by the latch body for engagement with the slotted receiver. The latch bolt has al least two biased indented positions. The latch assembly may include a more secure dead bolt striker plate for existing internal dead bolts that provides even greater security when the striker plate is extended from between the door and the casement and secured between the security door latch body and the door casing.

A unique mounting is provided for the latch body by providing a threaded mounting stud extending from the interior located latch body through the door encasement and retained exteriorly by a recessed threaded collar. A unique key is provided for allowing the door latch to be released from the door casement in an emergency by removing the exterior threaded collar or by unscrewing the threaded stud.

19 Claims, 9 Drawing Sheets

SECURITY BOLT LATCH APPARATUS AND METHOD

1. FIELD OF THE INVENTION

This invention pertains to auxiliary dead bolt type, surface-mounted security door latch apparatus that are operable from within the protected enclosure with the additional capability of allowing partial opening of the protected door while still providing some door security. More specifically, the security door latch apparatus includes reinforcement for existing internal dead bolt striker plates and external, emergency latch release mechanism.

2. GENERAL BACKGROUND

The security of enclosures accessible by way of doors has been the subject of many forms of latch and lock contrivances. Latches accessible only from within the served enclosure include key-served tumbler locks, dead bolts, slotted latches, and links such as chains, just to name a few. Tumbler locks and the usual dead bolts lose their security feature when actuated to open the door a small amount. Occasionally there is a need to allow a slight opening of a door without totally losing control of the access limitation a small opening provides such as in hotels and motels where room cleaning services are often provided with a passkey. Normally the short chains, secured to the doorframe and fastened to the door with screws, serve quite well. However, unauthorized entry is often gained through the use of bolt cutters extended through the slightly opened door, thereby readily cutting the chains. Slotted ridged latches and chains are both only as strong as the fasteners by which they are attached. Therefore, extreme force is often used to break such latches or simply dismount them. Most such latches are made from light weight stamped plate, such as may be seen in U.S. Pat. Nos., 5,531,490, 646,810, 6,354,32 1,799,265, and 1,388,712, and are mounted, in most cases, in a manner whereby the shot bolt receiver is located on the door frame adjacent the door and the latch bolt is fastened to the door, thus exposing the bolt to potential shearing by an intruder. When such sliding bolt latches are used as security latches for personnel entrance or access doors they are generally mounted with light screws secured to the door facing and the door itself. Generally speaking, the slide bolt latch is the only defense the occupant has when partially opening the door. It should be essential that the allowable opening be kept to an absolute minimum and that the elements of the slide bolt latch be of sufficient strength to resist extreme force and still be able to maintain a substantial purchase on the mounting surface. The wider the door is allowed to open when latched, the more adverse strain may be applied.

Mounting such light weight latches, such as those cited above, to the door and door facing have proven to be insufficient for security purposes due to poor construction, light weight materials, and insufficient depth of the screws to penetrate the facing and reach into the wall framing located behind the facing. Such slide bolt door latches are quite well known for their ability to pinch fingers when attempting to release the latch for opening the door. In addition these latches tend to hang on the door when not in use and cause damage to the door or door casing, especially in the case of the 1,388,712 patent cited above.

More recently it has become mandatory in some apartment building, hotels, motels, and the like to provide some means of over-riding the internal latch apparatus to allow emergency access in cases where the occupant has actuated both the door's dead bolt and the internal security latch. The use of a passkey for the dead bolt lock is ineffective in such cases. Therefore, unauthorized tactics must be employed to gain entry to disabled occupants in situations where time is critical. Such entry over-riding tactics are often very destructive, time consuming, and very disturbing to adjacent occupants. Obviously, if such tactics can be avoided lives may be saved and property destruction can be reduced. It is therefore an object of the invention disclosed herein to provide a security bolt latch for the limited opening of doors that includes a way to physically release the latch assembly in an emergency by authorized personnel without damage to the door or wall framing with a minimal disturbance to adjacent occupants.

3. SUMMARY OF THF INVENTION

A dead bolt latch body is externally mounted to an interior door encasement by an unconventional method. The latch, including a slotted receiver fastened to a door hinged adjacent the latch, further includes a shot bolt carried by the latch body for engagement with the slotted receiver. The shot bolt has a straight portion ending in a crank with an extending journal. The latch bolt has three indented positions. A first position exists when the bolt is fully retracted and inactive. A second position exists when the bolt is advanced toward the door and the journal engages the slotted receiver for limited door opening. A third position exists when the bolt is advanced toward the slotted receiver until the straight portion of the bolt engages the slotted receiver to act as a conventional dead bolt to prevent any opening of the door. When the journal is engaged with the slot defined as the second position, the door can be opened as the journal moves along the slot, rotating the bolt, to an extent permitted by the crank throw and is defined as a fourth position. To prevent the bolt being pushed to release the striker plate when the door is slightly opened, the body has an abutment that engages the crank, if it is not vertical, to prevent movement of the bolt toward the first, or unlatched, position. An alternative provides an enlargement on the end of the journal and an enlarged opening near the end of the slot to accept the enlargement. Once the door opens some to move the journal along the slot, the narrower slot will not permit the enlargement to be withdrawn. A second alternative is to provide a cam on the bolt to engage a slot in the surface of the bore to limit movement of the crank to rotation or axial movement but not both. The crank can rotate in only one axial position of the bolt and it cannot move axially when the crank is anything but vertical. This third position provides full dead bolt locking and, in that position, the door cannot be opened any amount. A finger lever is provided on the bolt to prevent operation of the latch by gripping the crank to protect fingers. To stabilize the bolt, a side load-biasing device is used. A leaf spring attached to the body and bearing upon the bolt is one example of providing biasing for the detents on the bolt at the positions represented by the four principal positions. A common spring and ball detent assembly may replace the leaf spring. The slotted receiver may, as an alternative, be provided as a box structure to prevent access to the crank and striker interface to prevent pinching of fingers if the door is moved during the latching process.

Providing a more secure dead bolt striker plate for existing internal keyed dead bolts provides even greater security when the striker plate is extended from between the door and the casement and secured between the security door latch body and the door casing. A unique mounting is provide for the latch body by providing a threaded mounting stud extending from the interior located latch body through the door encasement and retained exteriorly by a recessed threaded collar. A special key may remove the collar or the threaded stud, thereby allowing the door latch to be released from the door casement in an emergency.

4. BRIEF DESCRIPTION OF THE DRAWINGS

For a further understanding of the nature and objects of the present invention, reference should be made to the following detailed description taken in conjunction with the accompanying drawings, in which, like parts are given like reference numerals, and wherein.

Figure 13:
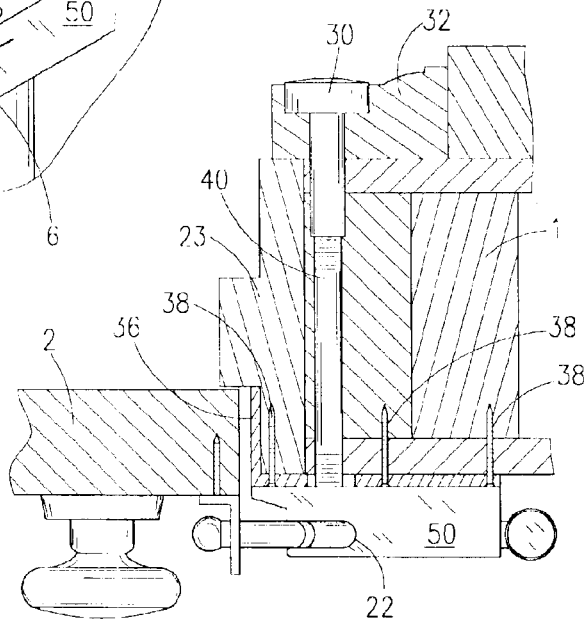
FIG. 13 is a cross section view of the door, doorframe, and wall elements taken along the plane in the direction of sight lines 4—4 seen in FIG. 4 exposing a top view of the latch assembly and release elements.
Figure 15:
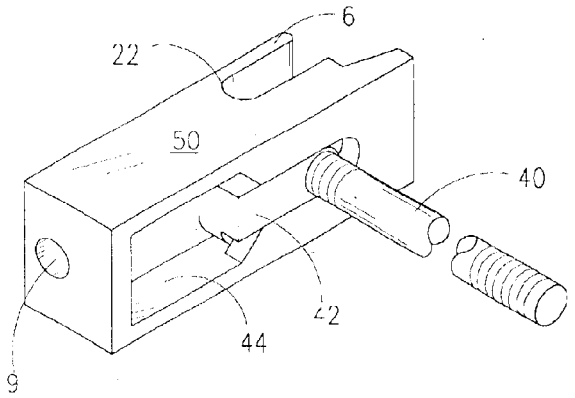
FIG. 15 is a rear isometric view of the second embodiment latch body with releasable mounting assembly.
Figure 15A:
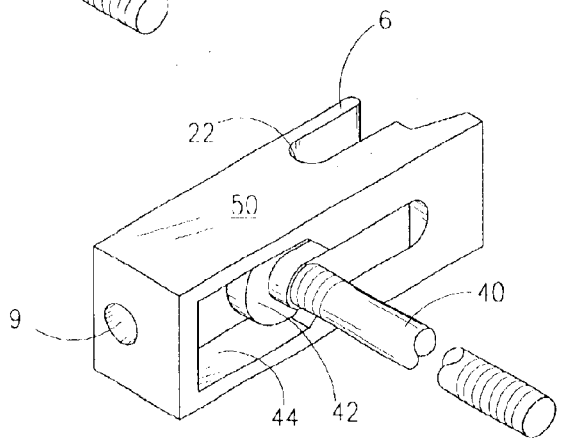
Figure 16:
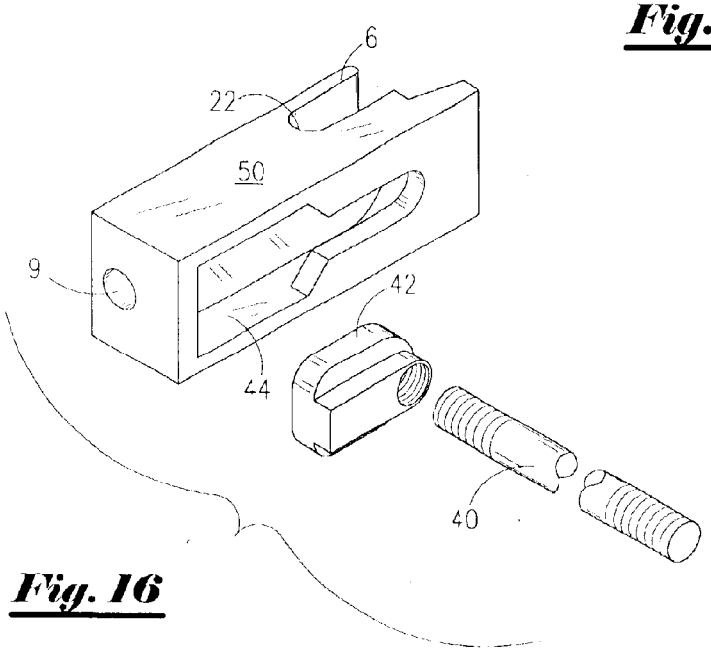
Figure 18:
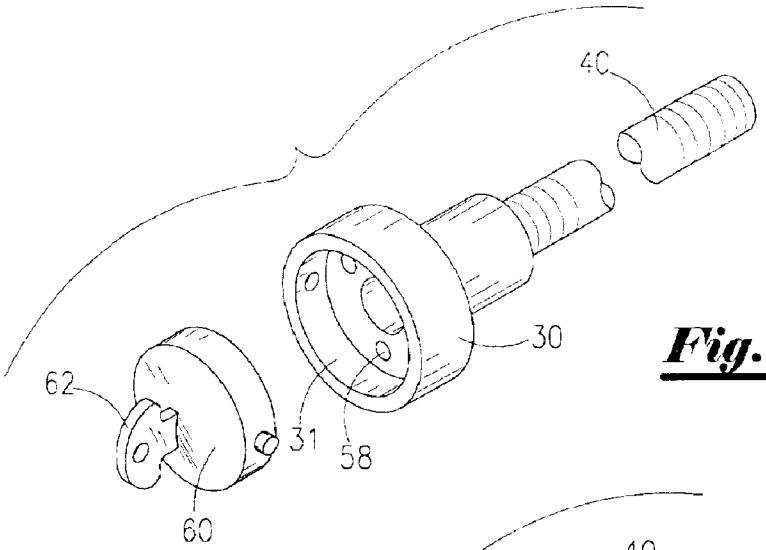
Figure 17:
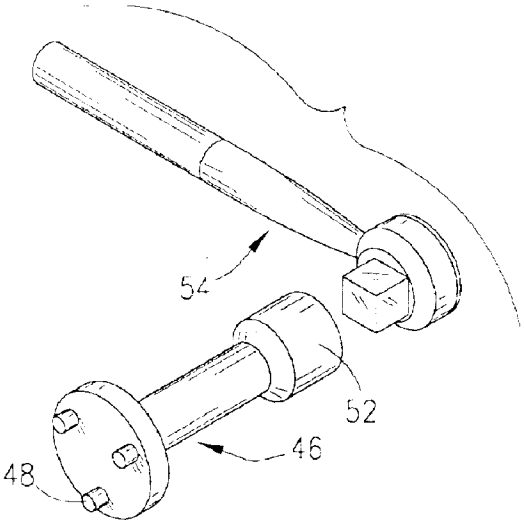
Figure 17A:
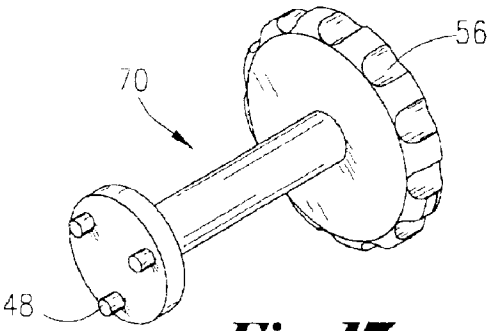
Figure 19:
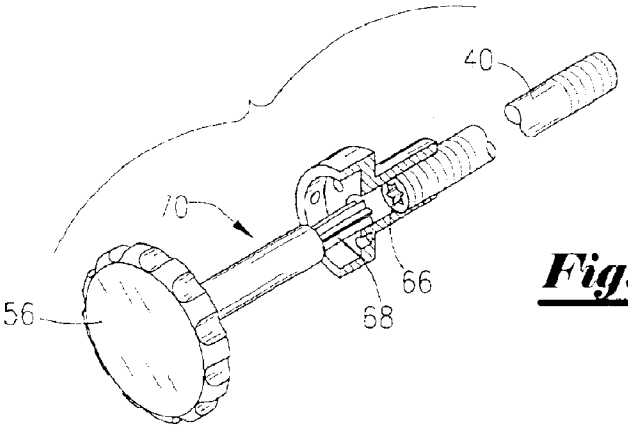
Figure 20:
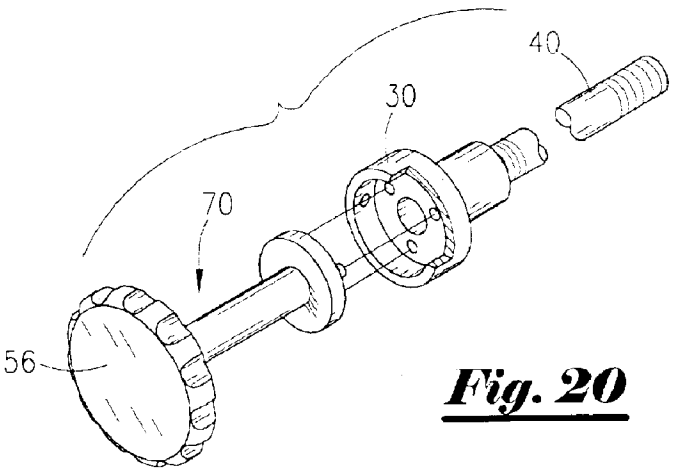
Figure 20A:
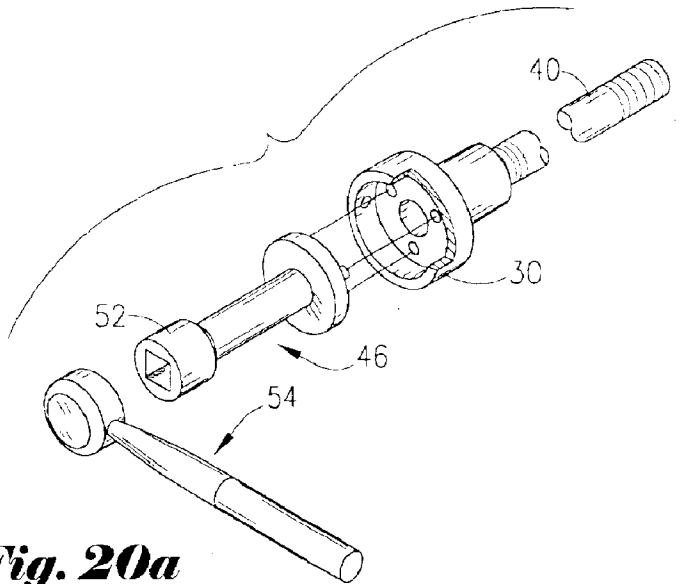
Figure 21:
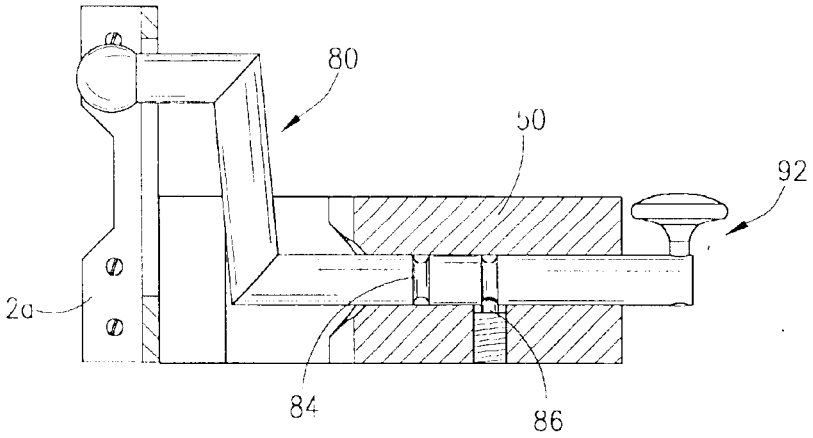
Figure 22:
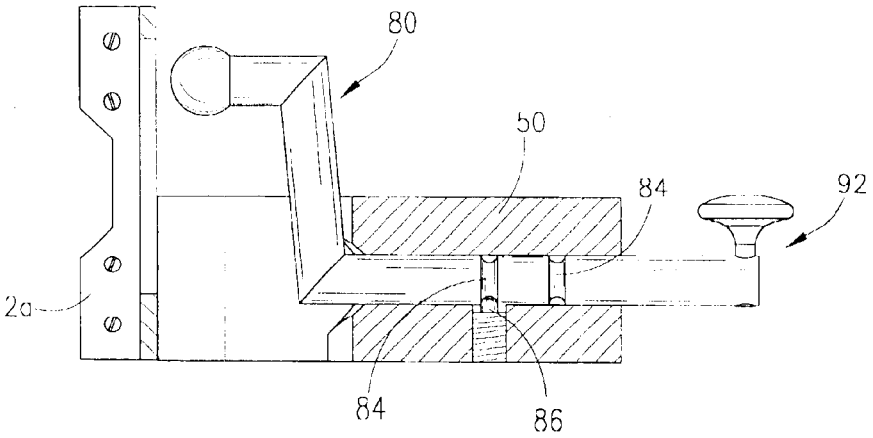
Figure 23:
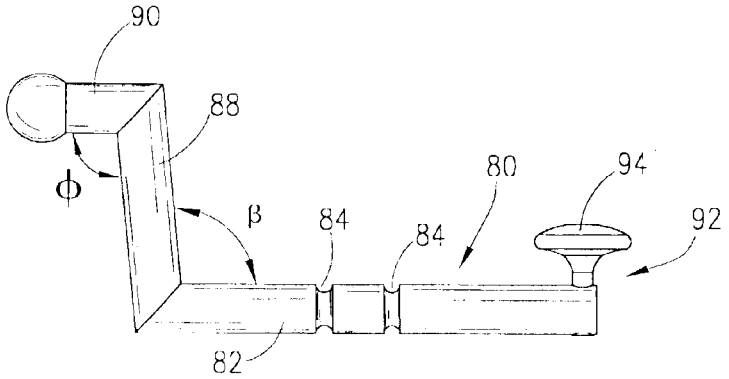

FIG. 15*a* is a rear isometric view of the second embodiment latch body with releasable mounting assembly showing reversibility of the T-nut;

FIG. 16 is an exploded isometric view of the latch body assembly seen in FIG. 15;

FIG. 17 is an isometric view of a release key and handle assembly;

FIG. 17*a* is an isometric view of an alternative release key and handle assembly;

FIG. 18 is an isometric view of the exterior elements of the release mechanism shown in FIG. 13 with alternative plug;

FIG. 19 is an isometric view of an alternative release key and release mechanism assembly;

FIG. 20 is an isometric view of the release key handle and release mechanism shown in FIG. 13;

FIG. 20*a* is an isometric view of the release key shown in FIG. 20 with ratchet handle;

FIG. 21 is a partial cross-section view of the latch assembly indented in the latched position;

FIG. 22 is a partial cross-section view of the latch assembly indented in the unlatched position;

FIG. 23 is front elevation view of the sliding latch bolt; and

Figure 24:
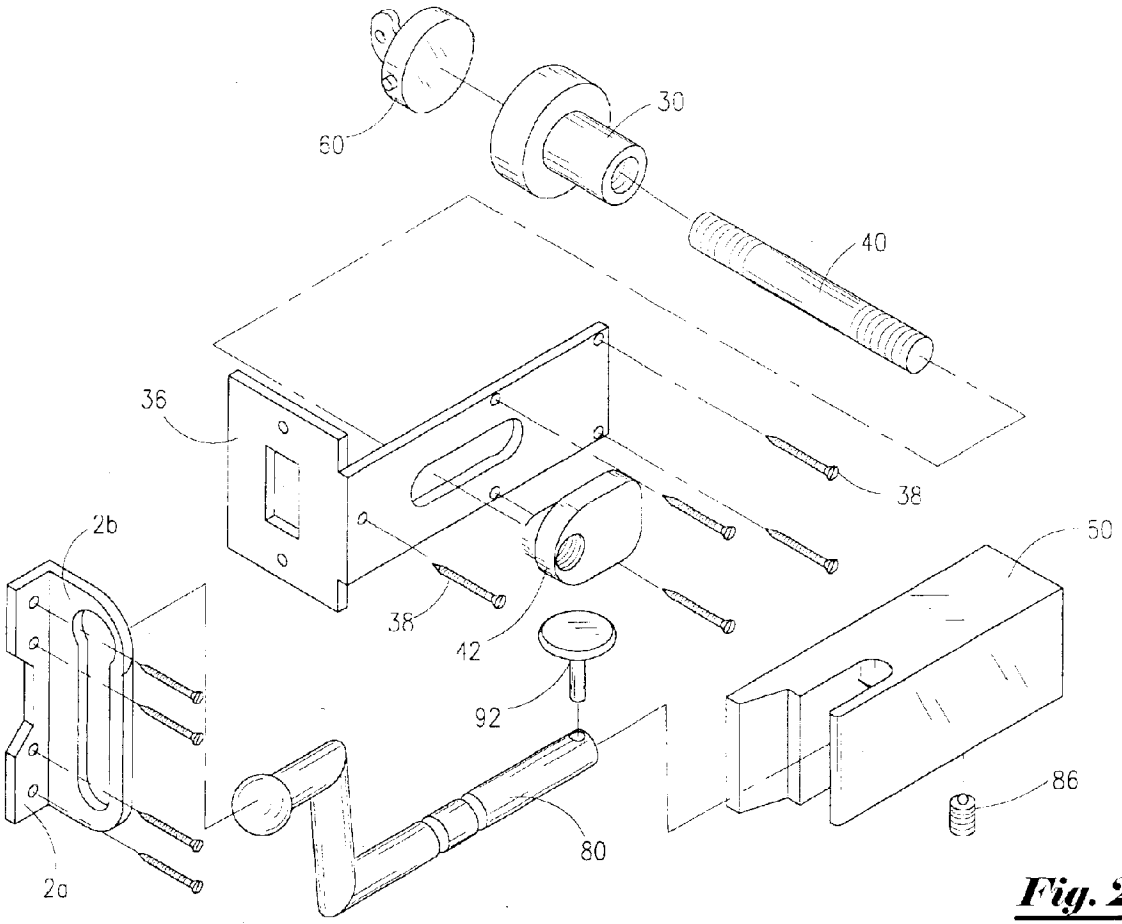

FIG. 24 is an isometric exploded view of the second embodiment of the latch assembly with alternative dead bolt striker.

5. DETAILED DESCRIPTION OF THE PREFERRED EMBODIMENT

In some drawing figures certain features well established in the art and not bearing upon points of novelty are omitted in the interest of descriptive clarity. Such omitted features may include weld lines, some threaded fasteners, threaded joints, pins, and the like. In all drawing figures, the structure of the door, doorframe, and mounting screws may be considered symbolic. The latch being described is intended for use as a security latch for personnel access doors. Its size, materials, and safety release mechanism may make it prohibitive for use in most other applications. The latch may be used on most door arrangements provided that the door is hinge-mounted and opens in the direction of the latch or interior of a dwelling or occupied space. The screw locations and the screw centerlines are defined as mounting means in some figures. It should be understood that, although one embodiment of the latch utilizes an external releasable mounting means, the latch body of either embodiment may be conventionally mounted with screws, if desired, without the release mechanism.

Figure 1:
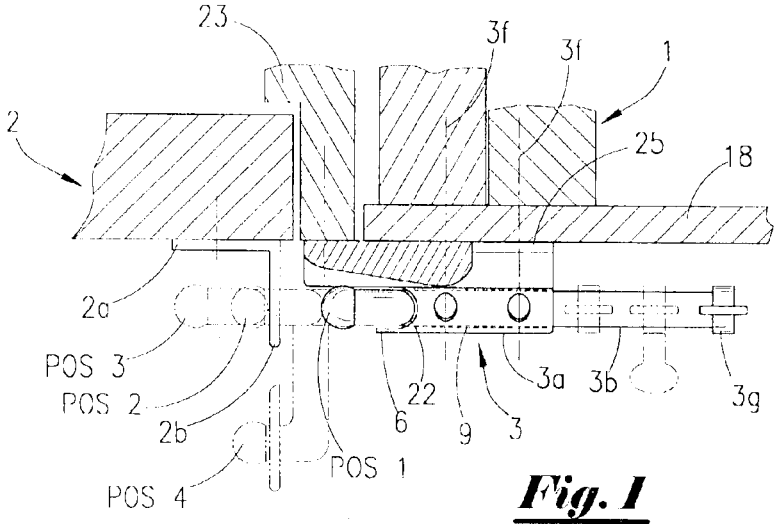
FIG. 1 is a top view of a first embodiment of the latch assembly as installed, with the frame and door served by the latch shown in partial cross-section just above the latch assembly.
Figure 2:
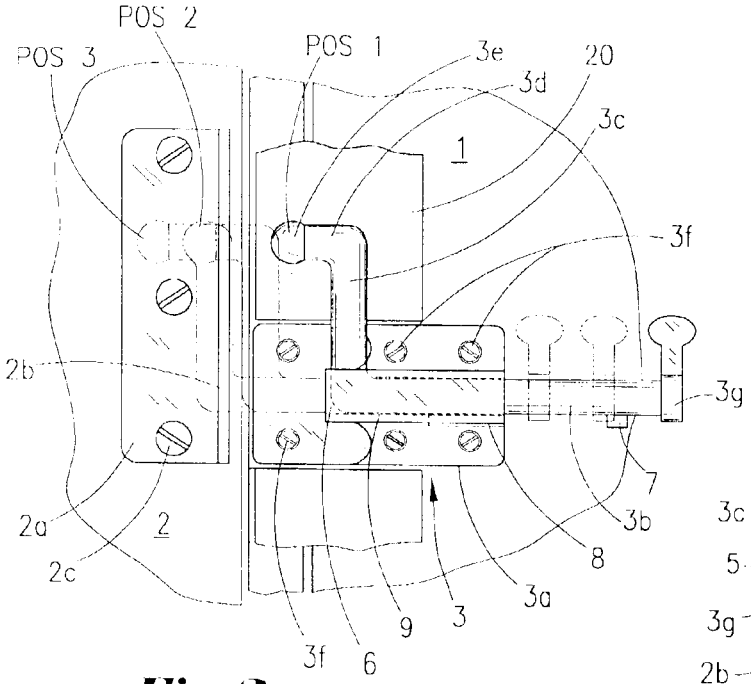
FIG. 2 is a front elevation view of the first embodiment of the latch assembly, shown as installed, with a partial view of the frame and door served by the latch.
Figure 3:
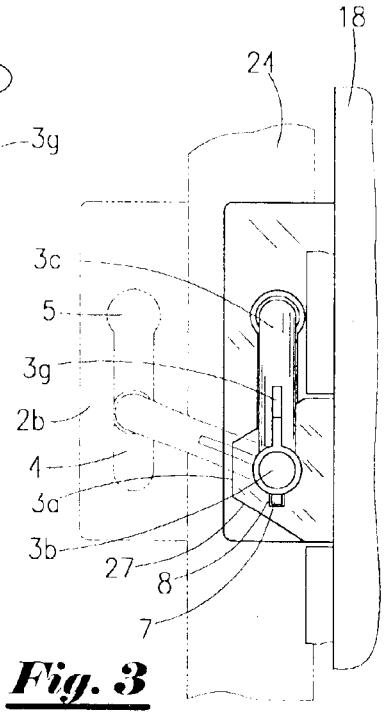
FIG. 3 is a side view of the first embodiment of the latch assembly as installed with the door in an open position shown in phantom.
Figure 10:
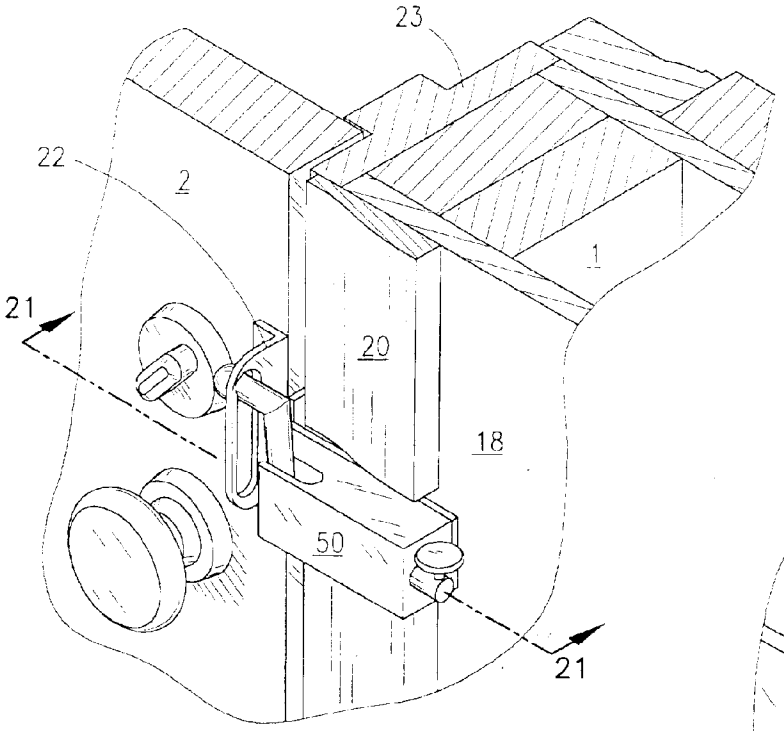
FIG. 10 is an isometric view of a second embodiment of the latch assembly as attached to a door, doorframe, and interior wall elements shown in partial cross section.

In FIG. 1 the latch assembly 3 is mounted on a doorframe comprised of a structural wall encasement including structural members 1, a wall covering 18, and the door facing 23 by notching out a portion of the door frame molding 20 as seen in FIG. 2 to insure solid contact between the latch body 3*a* and the wall covering 18 and attachment to the wall encasement structural members 1. The latch assembly 3 is provided to prevent the door 2 from being pushed open toward the latch body 3*a* when the shot bolt 3*b* is secured. This apparatus is simply an external dead bolt arrangement utilizing a crank shaped shot-bolt 3*b* having a straight portion carried by, and axially movable within, a bore 9 extending through the extent of the latch body 3*a*. The latch body is a heavy-duty rectangular block having a front or outer face and a rear or blind face 25. The front or outer face may include a chamfer 27 as seen in FIG. 3 along each of its longitudinal sides on some models. Projection 6, associated with latch bodies 3 and 50 from FIG. 10, is created by milling a channel 22 the same diameter as the shot-bolt bore 9 perpendicular to the bore and parallel to the outer face longitudinally from one end along the central axis of the bore 9 seen in FIGS. 5 and 16. A longitudinal portion of the material located between the channel and the outer face of the body member may be removed in some cases to allow access to fasteners 3*f* as seen in FIG. 2.

Unlike the usual surface-mounted dead bolt latch, whereby the bolt is rotated into position within the receiver by a gear rack, one end of the shot-bolt 3*b* in the latch disclosed herein includes a crank shaped arm 3*c* carrying neck, or journal, 3*d* culminating in an enlargement 3*e* at the end. It should be noted that the length of arm 3*c* should be kept to approximately 1½ to 3 times the door thickness, thus maintaining a minimal opening of the door. This minimum opening also reduces stress applied to the receiver portion 2*b* as a result of the enlargement 3*e* being extracted from the slot 4 as a result of the pivotal arch of the door. Lengthening the arm 3*c* to allow for a greater opening of the door requires a lengthening of the neck 3*d* and or a greater space between the body 3*a* and the receiver 2*a* to insure contact between the shot-bolt and the receiver slot 4 when the door is in the retained open Pos. 4. It should also be noted that the bend angles of the arm 3*c* and straight portion of the bolt and the between the arm and neck are not true 90 degree bends but are slightly larger and reflect the combined angle of the allowed door opening, thus preventing lateral stress on the receiver 2*a* by the enlargement 3*e* and binding of the bolt against the inner edge 24 of the door 2.

The body 3*a* may be attached to the wall and structural door framing in several ways, for example in the conventional manner using several screws 3*f* having sufficient length to penetrate the wall covering and extending a considerable depth into the structural door framing 1. It is also recommended that a portion of the doorframe molding or facing 20 shown in FIG. 1 be removed to allow the body 3*a* to gain better purchase on the wall covering 18. It should be noted that screw holes passing through the body 3*a* used for mounting should be recessed and counter bored to insure proper head seating relative to the beveled portions of the body 3*a*. The bolt receiver 2*b* is secured to the door 2 by screws 2*c* and has a slot 4 with an optional enlarged bore 5 shown more clearly on FIG. 3.

Enlargement 3*e* can just pass through the enlarged bore 5 of the bolt receiver 2*e* but it cannot move through narrower slot 4 portion of the bolt receiver. The shot-bolt 3*b* moves axially between the three positions 1, 2, and 3 shown in FIGS. 1 and 2, and may be rotated to Pos. 4 from Pos. 2 when the bolt 3*b* is in Pos. 1 to a 4th position, thereby allowing the door to be opened a short distance while still retained by the bolt. When the bolt 3*b* is moved to Pos. 2, the bolt engages the bolt receiver 2*a*, with neck 3*d* in slot 4, but the bolt 3*b* may be rotated to move to Pos. 4 to allow the door to open slightly. The neck portion 3*d* of the bolt 3*b* is allowed to slide within slot 4 until the crank 3*c* is at or near horizontal. It is essential that the neck 3*d* be kept to a minimum length only spanning the gap between the door 2 and the doorjamb. This and the fact that the optional enlargement 3*e* prevents the bolt from axial retraction from the receiver 2*a* when in the $4^{th}$ position prevent possible intruders from forcing the bolt from the receiver 2*a*.

It should be observed that locating the body member 3*a* on the door and the receiver on the door jamb, as is common in the prior art, is not recommended for this type of security latch since linear force applied to the door would be applied directly to the thinnest portion of the receiver 2*a* and place its mounting screws in tensile. Such an arrangement would allow the receiver 2*a* to be easily broken with minimum effort. The arrangement as shown herein in FIGS. 1–3 allows all force to be transferred directly to the door 2, the shot-bolt 3*b*, and thus to the body 3*a*.

Figure 6:
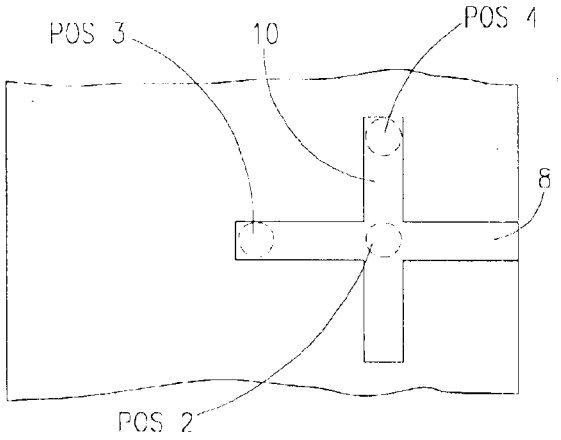
FIG. 6 is a development of the inner surface of the slide bolt bore within the body detailing grooves provided as a guide path for the guide pin seen in FIG. 4.

When the bolt 3*b* is moved to Pos. 3, the crank 3*c* portion of the bolt 3*b* extends through the slot 4 portion of the receiver 2*a*, thus the door cannot be opened. The effect is that of a conventional dead bolt. In Pos. 3, the crank arm 3*c* could move away from the door 2 and rotate the shot bolt 3*b*. Such rotation would not compromise the latch assembly 3 but it is undesirable. To prevent rotation of the bolt while in Pos. 3, a pin 7 is inserted into the shot-bolt 3*b* situated to enter a slot 8 machined into the latch body 3*a* via bore 9 to keep the crank vertical as shown in FIG. 6.

The bolt projection 6 located on the latch body 3*a* seen in FIG. 2 holds the crank in a vertical or downward position when the bolt is in Pos. 1 so that axial movement of the bolt 3*b*, with the door closed, results in alignment of journal 3*d* with slot 4 and the bolt 3*b* and receiver 2*a* are in proper alignment. The projection 6 is arranged to confine the crank to a vertical position when the body 3*a* is mounted on either the left or right of the door.

Finger lever 3*g* provides for the operation of the bolt without getting the fingers in position to be pinched by action of the crank arm 3*c* in the slot 4.

Figure 4:
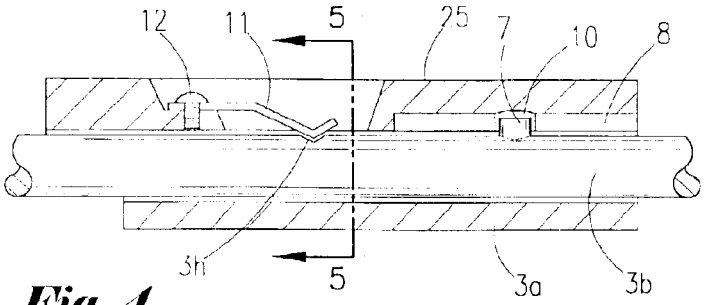
FIG. 4 is a partial cross-section view of the latch assembly shown in FIG. 1 showing a detent and guide pin locations relative to the slide bolt.
Figure 5:
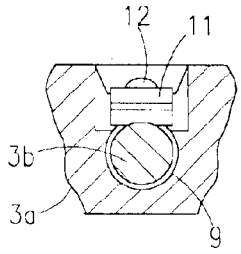
FIG. 5 is a cross-sectional view, taken along line 5—5 of FIG. 4.

FIG. 4 shows a leaf spring 11 located in a cavity located within blind side of the body 3*a* and secured thereto by a screw 12 to apply side load to keep the bolt 3*b* from rattling about in bore 9 as seen in FIG. 5. The spring can also engage notches, such as 3*h* seen in FIG. 4, to give a detent effect to bolt movement, thereby maintaining fixed shot-bolt positions. The shot-bolt as shown in Pos. 2 in FIG. 6 may be rotated to Pos. 4 with pin 7 moving in a second groove 10 perpendicular to groove or slot 8 machined into the wall of the bore 9. Groove 10 extends in both lateral directions from groove 8 so that the body 3*a* can be used for left or right swing doors.

Figure 7:
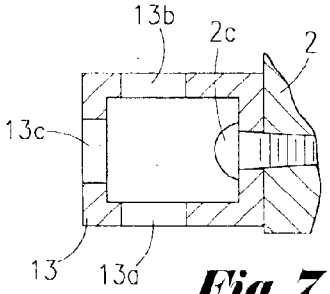
FIG. 7 is a cross-sectional view of the retainer taken along sight line 7—7 seen in FIG. 9.
Figure 8:
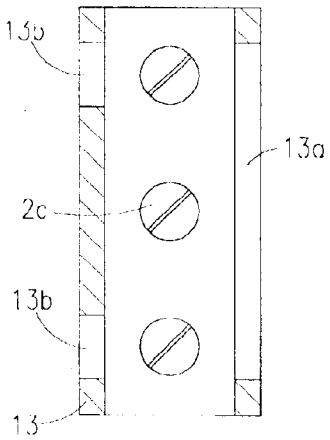
FIG. 8 is a cross-sectional view of the retainer taken along sight line 8—8 of FIG. 9.
Figure 9:
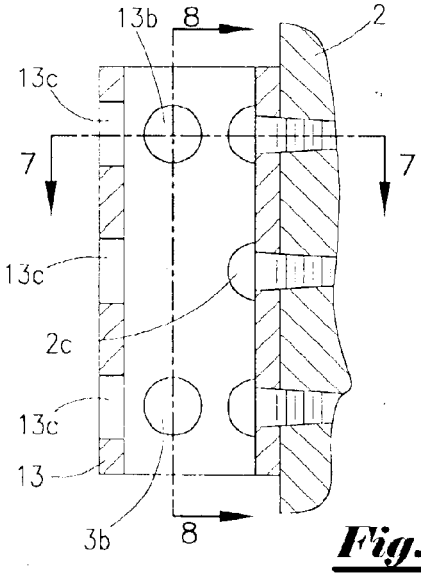
FIG. 9 is a cross-section view of the retainer as installed on a door shown in partial cross-section.

An alternate striker configuration is shown in FIGS. 7, 8, and 9. This is a box structure 13 and serves the same purpose as striker 2*b* with the added feature of reducing the likelihood of getting fingers caught between the crank and the door when the door is pushed against the crank. When the bolt is in Pos. 2, the journal extends into slot 13*a* and can rotate to Pos. 4 when the door is opened slightly. When the bolt is moved to Pos. 3, the journal extends through optional holes 13*b* and the striker can be narrower yet accept the crank 3*c* as seen in FIG. 2. There are two holes 13*b* to allow the striker to be mounted on either the right or left side of the door. Holes 13*c* are access ports for installing the screws 2*c*. The leaf spring arrangement of FIG. 4, and 5 does the same as the spring and ball detent mechanism common to the art of machine construction. Such spring and ball assemblies can be purchased in a variety of sizes for mounting in a threaded hole.

Figure 11:
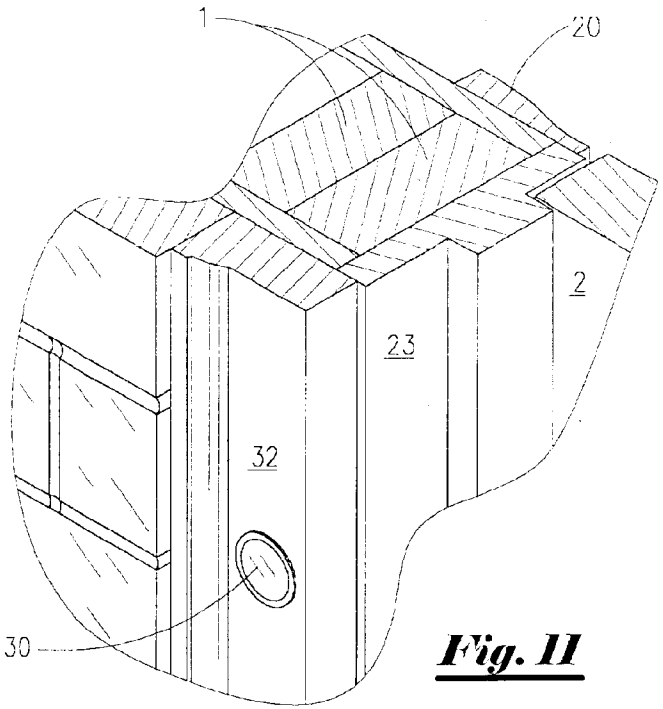
FIG. 11 is an isometric view of an exterior wall component of the release apparatus connected to a second embodiment of the latch assembly with wall and door elements shown in partial cross-section.

Looking now as FIG. 10, we have a second latch body embodiment 50 of the a latch body 3 which is generally the same except it is now adapted to be mounted by an externally releasable mechanism recessed into exterior door molding 32 and concealed as much as possible so as to be inconspicuous as seen in FIG. 11.

Figure 12:
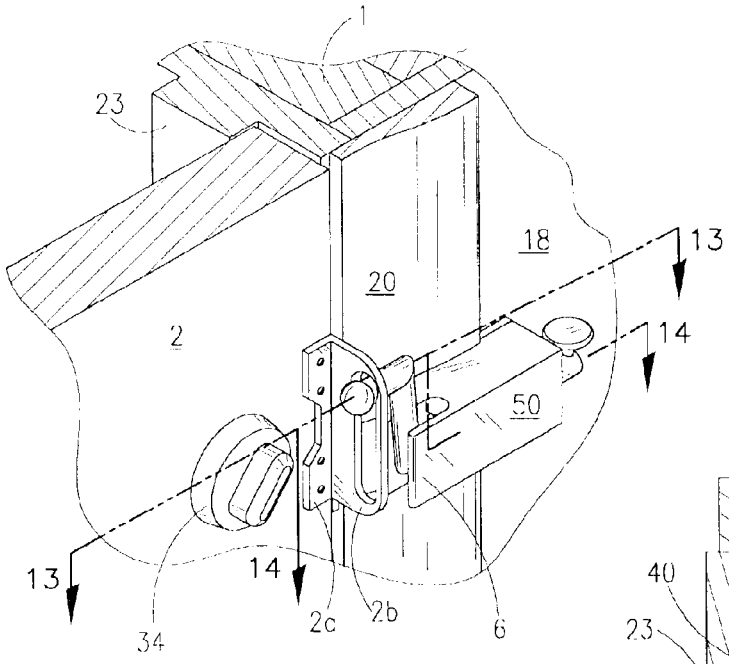
FIG. 12 is an interior isometric view of the second embodiment of the latch assembly as installed with door and frame shown in partial cross-section.

As seen in FIG. 12 the releasable latch body 50 may be mounted in the same general area as the first embodiment 3. However, in some cases, either of the latches may be located adjacent the door's dead bolt latch 34. The conventional dead bolt latch has a tongue that is extended from within the door into a recess located behind a striker plate, also recessed somewhat into the door facing 23. It is not unusual for the recessed dead bolt and its striker to simply break out of the facing 23 when force is applied to the door 2, thus the need for the additional safety latch assembly taught herein. Therefore, it should be noted a bent 90 degree angle dead bolt striker plate 36 including an striker face and an anchor face portion may be furnished which can be secured to the door facing 23 the wall covering 18 and to the frame structure 1 with screws 38 prior to installing either of the latch bodies 3, 50 as seen in FIG. 13 and 24 as a alternative to the dead bolt's striker furnished with the internal keyed dead bolt latch assembly. The latch bodies 3, 50 may be adapted to receive the mounting release mechanism that includes a threaded stud 40 and a recessed threaded collar 30. The threaded stud 40 threadably connected to the latch body 50 provides the only means of securing the body to the wall casement. With the stud 40 extending through the wall casement and secured therein by the threaded collar 30 threadably connected to the stud 40, it is virtually impossible to remove the latch body from the wall by force applied to the door 2. The threaded stud 40 and the threaded collar 30 provide extensive latitude for varying wall thickness. Any attempt by unauthorized persons to remove the collar 30 is further complicated by the use of left hand threads applied to the stud 40.

Figure 14:
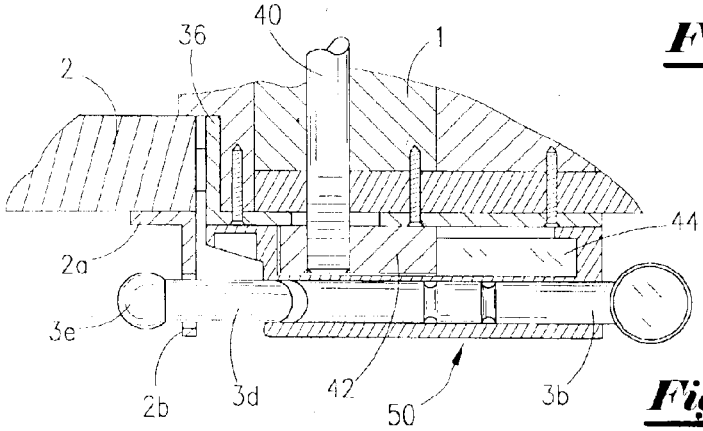
FIG. 14 is a cross section view of the latch assembly seen in FIG. 3 taken along sight lines 5—5.

As seen in FIG. 14, a threaded member or T-nut 42 that is insertable within an enlarged cavity or chamber and slidable along an elongated channel 44, better seen in assembly in FIG. 15 and exploded in FIG. 16, threadably retains the stud 40 within the latch body 50. The stud may just as easily be threaded into the latch body 50. However, the internally threaded offset T-nut 42, cavity, and channel 44 arrangement allows for greater latitude in locating the stud 40 and latch body 50 relative to the exterior molding 32 or structural members 1 by reversing the offset T-nut 42 within the cavity and channel 44 as shown in FIG. 15*a*.

The collar 30 may be tightened or removed in a variety of ways. For example, a spanner key 46 as seen in FIG. 17 fitted with a plurality of pins 48 arranged in a an irregular pattern to correspond to the matching holes located within the collar 30, having a socket head 52 for cooperative operation with a ratchet handle 54 as seen in FIG. 17 or perhaps adapted to a handle 56 as shown in FIG. 17*a*. An example of the cooperation of the spanner key tool 46 relative to the collar 30 may be seen in FIG. 20 and FIG. 20*a*.

The collar 30 as shown in FIG. 18 may be configured with a recessed portion 31 having a shoulder or key seat for locating the spanner holes 58. Some means for covering the recess 31 may be provided as a means for concealment in the form of a removable keyed plug cover 60 having a unique key or a plain snap-in plug or cap member 64.

Alternatively, the stud 40 may be counter bored at one end with an internal, irregular spline 66 rotatable by a matching key 70 having a cooperative external spline 68 as shown in FIG. 19. In this case the stud is being removed from the T-nut 42 instead of removing the collar 30. In either case one of the unique release key tools 46, 70 may be provided for each group of latches 50 particularly identified with a particular key configuration.

It should be also observed that the latch body 50 may fitted with an alternative crank shaped shot bolt 80, as seen in FIG. 23, whereby the straight portion 82 of the bolt is grooved or notched 84 at two places to mate with biased indenting ball assembly 86 shown in FIG. 21 and whereby angle "B" between the leg 88 and the straight portion 82 and/or the angle "ø" between the neck 90 and the leg 88 is greater than 90 degrees for compensating for the angle of the door 2 in the open but latched position. The shot bolt 80 may be fitted with a handle 92 located adjacent the end of the straight portion extending perpendicular thereto and fitted with knob.

Figure 18A:
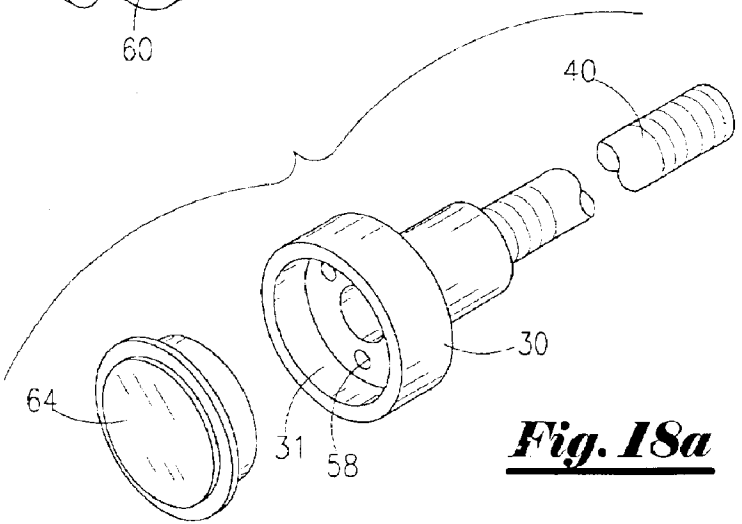

The indenting ball assembly means 86 is provided for temporarily retaining the shot bolt in the latched position as shown in FIG. 21 and in the unlatched position as seen in FIG. 22. Looking now at FIG. 24 we see that the latch assembly 3, 50 may be adapted for external security release by modifying the assembly by modifying the latch body 3*a* in the manner described by latch body 50 and providing the stud 40 collar 30 and plug cover 60 or plug 64 seen in FIG. 18*a*. Some assemblies may also include the T-nut 42; optional dead bolt striker plate 36, reconfigured shot bolt 80, and handle assembly 92 as well.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in any limiting sense.

What is claimed is:

1. An auxiliary, sliding bolt, door latch assembly for attachment to the interior side of a personnel access door and door frame wherein said sliding bolt may be positioned to retain said door in a partially open position, said latch assembly comprising:

a) a body member comprising:

i) a rectangular block having depth, a front and rear face, a longitudinal bore having a central axis, and a channel having a radius equal to at least half the diameter of said bore and having a central axis perpendicular to and intersecting said bore located parallel to said front face and extending longitudinally from one end along the axis of said bore;

ii) a means for securely mounting said body member to a structural wall located adjacent a hinged personnel access door opening; and iii) a machined cavity located within said rear face;

b) a crank-shaped bolt member having at least one indenting notch thereon, slidably disposed within said longitudinal bore;

c) a handle attached to one end of said bolt member;

d) an indent biasing means for maintaining said bolt member in a plurality of positions relative to said body member; and e) a receiver member having a slotted portion for receiving a portion of said crank-shaped bolt member and fastening means for securing said receiver to a personnel access door adjacent said body member.

2. The door latch assembly according to claim 1 wherein said means for maintaining said bolt member in a plurality of positions relative to said body member is a biasing means located within said body member for contacting said indenting notch.

3. The door latch assembly according to claim 1 wherein said means for maintaining said bolt member in a plurality of positions relative to said body member further comprises a pin attached to said bolt member slidable within a longitudinal and perpendicular groove located within said longitudinal bore.

4. The door latch assembly according to claim 1 wherein said bolt member further comprises a bulbous end.

5. The door latch assembly according to claim 1 wherein said crank-shaped bolt member comprises a straight length portion culminating in a handle, an arm portion, and a neck portion culminating in said bulbous end, said arm portion forming an angle greater than 90 degrees with said straight length portion and said neck portion forming an angle greater than 90 degrees with said arm portion.

6. The door latch assembly according to claim 1 wherein said body member further comprises a significant bevel along each longitudinal side of said front face.

7. The door latch assembly according to claim 1 wherein said means for securely mounting said body member is a plurality of threaded fasteners passing through a wall covering and extending a significant depth into a solid structural member of a wall.

8. The door latch assembly according to claim 1 wherein said latch assembly further comprises a striker plate cooperative with existing, internally mounted, keyed dead bolt assemblies, said striker plate comprising a striker face portion and an anchor face portion located at 90 degrees to said striker face portion, said anchor face portion corresponding to and mountable medial said body member and said door frame.

9. The door latch assembly according to claim 4 wherein said slotted portion of said receiver member further comprises an aperture at one end of said slotted portion of sufficient size to receive said bulbous end of said bolt member.

10. The door latch assembly according to claim 1 wherein said assembly further comprises: a) a T-nut having a threaded aperture located off center therein;

b) a stud having left and right hand threads threadably attached to said T-nut;

c) an internally threaded collar member threadably attached to said stud comprising:

i) a flange portion;

ii) a recessed shoulder portion located within said flange portion, said recessed shoulder defining an interior wall within said flange portion;

iii) a plurality of spanner apertures located within said shoulder portion; and iv) a cap member adaptively inserted into said interior wall for covering said spanner holes.

11. The door latch assembly according to claim 10 wherein said cap member is replaced with a keyed lock.

12. The door latch assembly according to claim 10 wherein said spanner apertures are arranged in patterns corresponding to a limited number of spanner keys.

13. The door latch assembly according to claim 10 wherein said stud comprises an internal irregular spline at one end.

14. The door latch assembly according to claim 13 wherein said irregular internal spline corresponds to a limited number of spline keys.

15. The door latch assembly according to claim 10 wherein said cavity located within said rear face of said body member further comprises an elongated channel extending longitudinally within said body member parallel to said rear face, a portion of said cavity further having a chamber at one end to allow insertion of said T-nut.

16. The door latch assembly according to claim 15 wherein said T-nut is reversible within said channel.

17. A method for providing a release means for surface mounted safety latches operable only from inside a personnel access door in emergencies comprising the steps of:

a) installing a releasable safety latch body to an interior wall adjacent an access door by passing a stud member through said wall and attaching said stud member to said latch body;

b) securing said stud and latch body to said wall by threadably attaching a flanged collar having a recessed key seat to said stud member, said collar being accessible and rotatable from an exterior side of said wall utilizing a key tool;

c) covering said flanged collar to disguise said key seat; and d) providing said key tool to emergency personnel for releasing said latch body in an emergency by threadably removing said collar from said stud member.

18. A method for providing a release means for surface mounted safety latches operable only from inside a personnel access door in emergencies comprising the steps of:

a) installing a releasable safety latch body to an interior wall adjacent an access door by passing a stud member having an internal spline at an end opposite said latch body through said wall and attaching said stud member to said latch body;

b) securing said stud and latch body to said wall by threadably attaching a flanged collar having a recess therein to said stud member, said collar being accessible and rotatable from an exterior side of said wall utilizing a spanner tool;

c) covering said flanged collar to disguise said recess; and d) providing a key tool to emergency personnel for insertion in said spline releasing said latch body in an emergency by threadably removing said stud from said latch body.

19. A method for gaining access to an occupied space by way of a door having a secured safety latch operable only from inside the space, said security latch having a releasable mounting means accessible from an exterior side of the door in emergencies comprising the steps of:

a) removing any means of concealment from the external release means;

b) inserting a keyed release tool corresponding to the external release-means; and c) rotating said keyed release tool in a manner whereby at least a portion of said release means is threadably detached from said secured safety latch thereby dismounting said safety latch.

* * * * *